US005467552A

United States Patent [19]

Cupp et al.

[11] Patent Number: 5,467,552

[45] Date of Patent: Nov. 21, 1995

[54] GUN SIGHT MOUNTING STRUCTURE

[75] Inventors: Carl J. Cupp, Hawaiian Gardens; Ronald L. Plue, Encino, both of Calif.

[73] Assignee: Pachmayr Ltd., Monrovia, Calif.

[21] Appl. No.: 321,761

[22] Filed: Oct. 12, 1994

[51] Int. Cl.[6] ..... F41G 1/16; F41G 1/387

[52] U.S. Cl. ..... 42/100

[58] Field of Search ..... 42/100, 101; 33/233, 33/245, 250, 252, 257, 260

[56] References Cited

U.S. PATENT DOCUMENTS

| | | | |
|---|---|---|---|
| 1,896,926 | 2/1933 | von Frommer | 42/100 |
| 2,030,312 | 2/1936 | Mossberg | 33/234 |
| 2,039,907 | 5/1936 | Jefferson | 33/234 |
| 2,438,601 | 1/1947 | Davis | 33/257 |
| 3,495,339 | 2/1970 | Elliason | 33/257 |
| 3,838,522 | 10/1974 | Williams | 33/258 |
| 4,688,345 | 8/1987 | Kilgour | 42/101 |
| 4,691,442 | 9/1987 | Center | 33/253 |
| 4,945,667 | 8/1990 | Rogalski et al. | 42/100 |

OTHER PUBLICATIONS

Pachmayr Ltd. Gun Sight–3 Photographs.

*Primary Examiner*—Charles T. Jordan
*Assistant Examiner*—Christopher K. Montgomery
*Attorney, Agent, or Firm*—William P. Green

[57] ABSTRACT

A gun sight assembly including a body to be held against a surface of a gun, a sight carried by the body, an anchoring part received within a dovetail groove in the gun, and a threaded fastener extending through an opening in the body and threadedly connected to the anchoring part and operable to pull the anchoring part toward the body in a manner tightening the anchoring part against converging side walls of the dovetail groove and tightening the body against the surface of the gun.

15 Claims, 3 Drawing Sheets

GUN SIGHT MOUNTING STRUCTURE

This invention relates to an improved arrangement for mounting a sight on a gun.

BACKGROUND OF THE INVENTION

A conventional way of mounting a sight on a gun is to provide an upper surface of the gun with a transverse groove of dovetail cross section into which a correspondingly shaped dovetail projection of the sight assembly is slidably insertable to attach the sight to the gun. The dovetail projection is a tight friction fit in the groove to form a rigid connection between the parts, and is an integral portion of an element which projects upwardly beyond the groove and carries the sight at the top of the gun, Installation of the sight on a gun requires precise filing or machining of the dovetail projection by an expert gunsmith in order to attain the desired rigid connection capable of withstanding the forces encountered in handling and firing of the gun. The gunsmith must carefully remove material from the undersurface of the dovetail projection until that projection has exactly the right degree of friction fit within the mating dovetail groove in the gun. The projection is then driven into the dovetail groove to mount the sight rigidly to the gun.

SUMMARY OF THE INVENTION

The present invention provides an improved sight assembly which can be attached to a gun without the above discussed necessity for filing or machining of a part of the assembly at the time of installation. The device includes an anchoring part which is slidable into the dovetail groove of a gun without filing or otherwise removing material from the gun, and which may initially be a relatively loose fit in the groove but be tightenable relative to a body of the device in a manner pulling the anchoring part toward the body and against converging opposite side walls of the groove until a rigid connection between the parts is achieved. A threaded fastener may extend through an opening in the body of the sight assembly and be threadedly connected to the anchoring part in the dovetail recess to enable the parts to be locked in position by tightening of the fastener.

BRIEF DESCRIPTION OF THE DRAWINGS

The above and other features and objects of the invention will be better understood from the following detailed description of the typical embodiments illustrated in the accompanying drawings, in which.

DETAILED DESCRIPTION OF THE PREFERRED EMBODIMENTS

Figure 1:
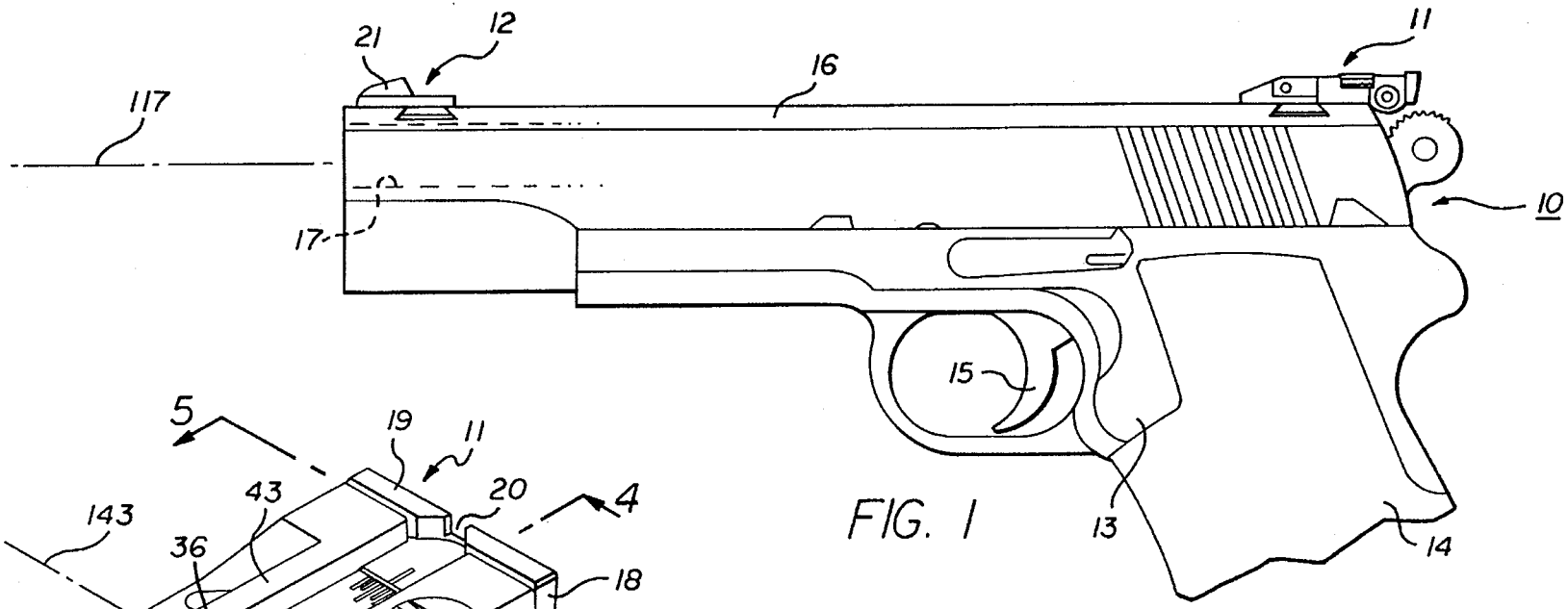
FIG. 1 is a side elevational view of the upper portion of a hand gun having forward and rear sights embodying the invention.

FIG. 1 illustrates at 10 a hand gun having a rear sight assembly 11 and a forward sight 12 embodying the invention. The gun 10 is typically illustrated as a semi-automatic pistol, but may be any other known type of gun such as a revolver, single shot pistol, rifle, shot gun or the like. The semi-automatic pistol shown in FIG. 1 has a frame 13 carrying a downwardly projecting handle 14, with the usual trigger mechanism 15 for firing the gun. A slide 16 extends about the upper side of the frame, and about the barrel 17, and is attached to the frame for front to rear sliding recoil movement relative to the frame and the barrel and other parts of the gun along the axis 117 of the barrel. The rear and front sight assemblies 11 and 12 are attached to the upper side of slide 16.

Figure 5:
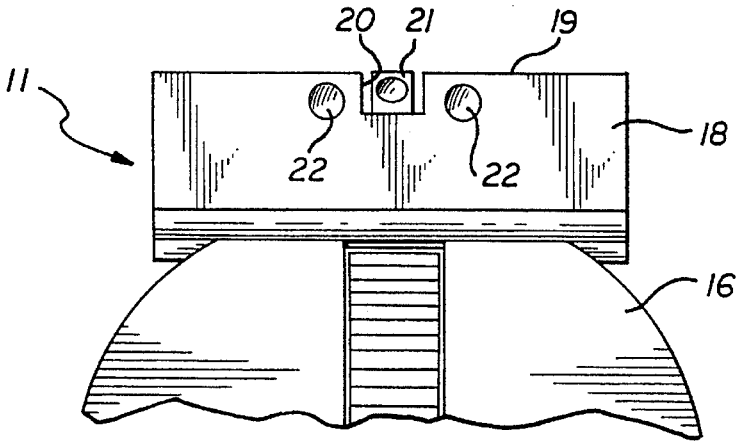
FIG. 5 is a rear view of the sight of FIG. 2, taken on line 5—5 of that figure.

Rear sight assembly 11 includes a sight element proper 18, which extends transversely of axis 117 and may have the outline configuration illustrated in FIG. 5 as viewed by a user in aiming the gun. More particularly, element 18 may be generally rectangular as viewed from the rear, and have a generally horizontal top surface 19 interrupted by a central groove or recess 20 through which a coacting sight element 21 of the forward sight assembly 12 is viewed when the gun is aimed properly. The rear surface of back sight element 18 may have two typically light colored circles 22 which the user aligns horizontally with a similar circle formed at the back of forward sight element 21 in aiming the gun.

Figure 4:
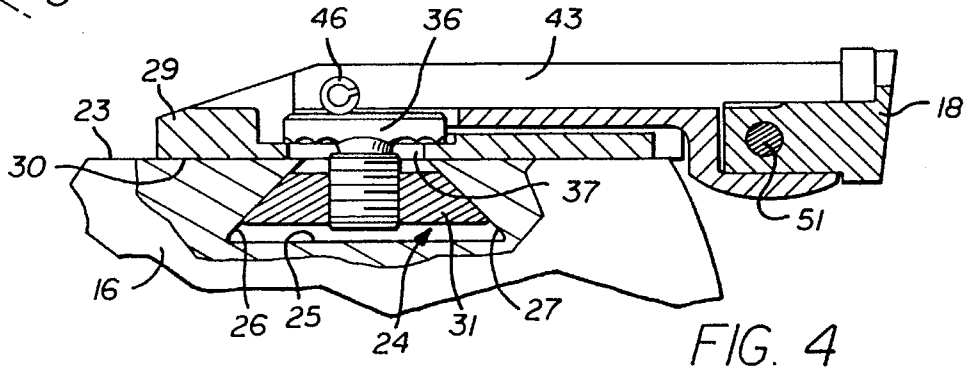
FIG. 4 is an enlarged central vertical section through the rear sight assembly taken on line 4—4 of FIG. 2.
Figure 2:
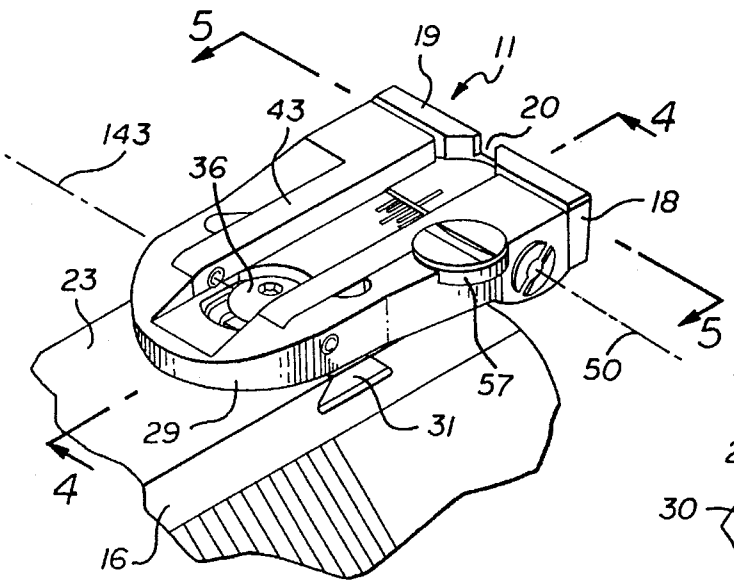
FIG. 2 is an enlarged fragmentary perspective view of the rear sight of the FIG. 1 gun.
Figure 6:
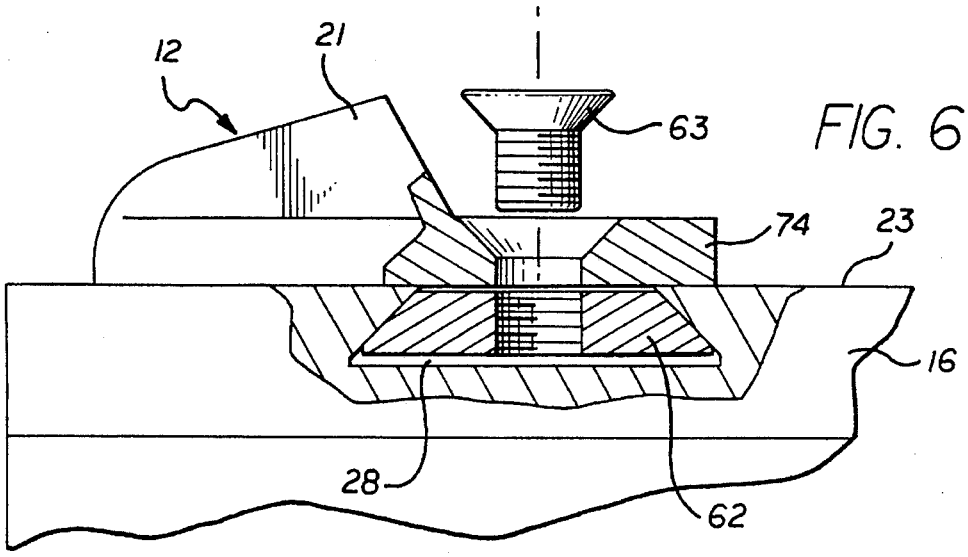
FIG. 6 is a side view, partially in section, showing the mounting of the front sight of FIG. 1.

Referring now to FIGS. 2 and 4, slide 16 of the gun has a horizontal planar upper surface 23 to which sight assemblies 11 and 12 are connected. At the location of rear assembly 11, the upper portion of the slide contains a dovetail groove 24 (FIG. 4), which opens upwardly at the location of top surface 23, and extends transversely of the gun. This groove 24 may be of uniform cross section along its entire length transversely of axis 117 of the gun, with that cross section being as illustrated in FIG. 4 to have a horizontal bottom wall 25 and two upwardly converging planar opposite walls 26 and 27 at the front and rear respectively of the groove. A similar dovetail groove 28 is formed in the upper surface of the slide at the location of forward sight assembly 12 (FIG. 6).

Rear sight assembly 11 includes a main body part 29 which is received at the top of the slide and has a horizontal planar undersurface 30 resting on top surface 23 of the gun both forwardly and rearwardly of groove 24, and tightenable downwardly against that surface 23. An anchoring part 31 of assembly 11 is received within dovetail groove 24, and has a dovetail cross section similar to that of the groove and adapted to be slidably inserted thereinto. The cross section of the anchoring part as viewed in the front to rear plane of FIG. 4 is defined by a horizontal planar undersurface 32 of the anchoring part, a parallel planar horizontal upper surface 33, and two opposite planar upwardly converging surfaces 34 and 35 disposed at an angle corresponding to surfaces 26 and 27 of the groove and engageable upwardly thereagainst. A screw 36 extends downwardly through an opening 37 in part 29, and is connected threadedly into a vertical bore 38 in part 31. The upper head 39 of screw 36 is engageable downwardly against an upper surface 40 of body 29, so that as screw 36 is tightened into anchoring part 31, the head of the screw 39 bears downwardly against body 29 to tighten it downwardly against upper surface 23 of the gun, while anchoring part 31 is pulled upwardly by the screw relative to body 29 and into tight engagement with the opposite walls 26 and 27 of dovetail groove 24, to form a very effective rigid connection between body 29 of the rear sight assembly and slide 16 of the gun. The cross section of anchoring part 31 is uniform along the entire length of that part between its opposite ends 40 and 140. The anchoring part may be further located relative to body 29 by provision of two upwardly projecting lugs 41 at the top of part 31, typically of circular horizontal section, with these lugs being received within correspondingly dimensioned cylindrical vertically extending recesses 42 formed in the underside of body 29 at opposite sides of screw 36 and threaded bore 38 in part 31. The interfitting relationship between lugs 41 and the mating recesses 42 prevents the body part 29 from turning about the vertical axis of screw 36 relative to anchoring part 31.

Sight element 18 may be mounted to body 29 of assembly 11 for vertical and horizontal adjusting movement relative to body 29 to attain elevation and windage adjustments of the sight element. For this purpose, element 18 may be carried by a part 43 which is received within a recess 44 formed in the top of body 29. Part 43 is connected to body 29 for limited upward and downward swinging movement about a horizontal axis 143 disposed transversely of the main front to rear axis 117 of the gun. To attain this pivotal mounting, part 43 has two arms 45 which project forwardly at opposite sides of screw 36 to allow access to that screw, and which are connected pivotally to opposite sides of body 29 by two aligned pivot pins 46 extending along the pivotal axis 143. The recess 47 formed in part 43 between its arms 45 is dimensioned to receive screw 36 and enable a user to pass a tool downwardly into engagement with that screw for attaching body 29 to the gun.

Rearwardly of the recess 47, the two arms 45 are joined by a central portion 48 of part 43, carrying a widened portion 49 at the rear of body 29 to which the sight element 18 is mounted for lateral adjusting movement along an axis 50 extending parallel to axis 143 and transversely of axis 117 of the gun. This lateral windage adjustment of element 18 is effected by manual rotation of an adjusting screw 51 which extends along axis 50 and through a transverse passage in portion 49 of part 43, and which has a head 52 at one end and a nut 53 at its opposite end engaging shoulders in part 43 in a manner retaining screw 51 against axial movement relative to part 43. Nut 53 is a lock nut which is frictionally retained in fixed position relative to screw 51 for rotary adjustment therewith. Within the interior of portion 49 of part 43, screw 51 threadedly engages a projection 54 formed at the forward side of sight element 18, so that rotation of screw 51 acts to adjust element 18 along axis 50 relative to part 43.

Part 43 is yieldingly urged upwardly relative to body 29 by two vertically extending parallel coil springs 55 which may be received adjacent the opposite side walls 144 of recess 44 in body 29, the springs preferably being located and confined within opposed vertical semi-circular grooves 56 formed in those side walls and in the outer sides of part 43. The springs bear downwardly against the upper surface of body 29 and upwardly against the undersurface of part 43 to urge the latter upwardly relative to the body. This limited vertical swinging movement of part 43 upwardly and downwardly relative to body 29 is controlled by an adjusting screw 57 which is threadedly connected into a vertical threaded bore 58 formed in one of the side walls 144 of recess 44 and at one side of portion 48 of element 43. Screw 57 has an upper enlarged head 59 bearing downwardly against an arcuate upwardly facing horizontal shoulder 60 formed on part 43 to limit upward swinging movement of part 43 under the influence of springs 55. Shoulder 60 may be formed partially in the front of widened portion 49 of part 43, and partially in the side of portion 48 forwardly of portion t49, as shown. A spring pressed detent ball 61 may be carried by part 43 at the location of its shoulder 60, to yieldingly engage a series of detent notches formed at the underside of head 59 of screw 57 to releasably retain that screw and the adjusted sight element in any desired vertical position.

To install the rear sight assembly 11 on the gun, screw 36 is first loosened slightly to allow anchoring part 31 to move downwardly a short distance relative to body 29 of the assembly, so that the assembly may be slid laterally into a position of interfitting engagement with dovetail groove 24, by sliding reception of anchoring part 31 within that groove. When the assembly is at a properly centered position relative to the upper surface 23 of the gun, the person installing the assembly tightens screw 36 downwardly relative to anchoring part 31 and against body 29, to clamp the body downwardly against upper surface 23 of the gun and tighten anchoring part 31 upwardly against the inclined upwardly converging opposite surfaces 26 and 27 of the dovetail groove, in a manner locking the assembly in position. Screw 36 may be actuated by any appropriate type of tool, typically by an fallen wrench engaging a hexagonal recess 73 in the head of the screw. After the assembly has been installed, sight element 18 may be adjusted upwardly and downwardly by manual rotation of screw 57, and may be adjusted laterally by manual rotation of screw 51, to introduce elevation and windage corrections into the sighting process.

For attaching the forward sight assembly 12 to the front of the gun, that assembly may include a horizontal plate 74 having a horizontal undersurface which engages the top surface 23 of the slide, with a separate dovetail anchoring part 62 being provided at the underside of plate 74 and being shaped in correspondence with the previously described anchoring part 31 of the rear assembly, and being slidably inserted into the front dovetail groove 28 of the gun. A screw 63 corresponding to screw 36 of FIG. 3 extends downwardly through an opening in plate 74 and is threadedly connected to anchoring part 62, so that when the upper enlarged head of screw 63 is tightened downwardly against plate 74, it draws anchoring part 62 upwardly against the converging opposite walls of dovetail groove 28, to lock plate 74 and its carried sight element 21 rigidly in position on the gun. Any other type of either fixed or adjustable sight may be attached to a gun in similar manner, such as for example an elongated rib sight, a quarter rib sight, or the like.

Figure 3:
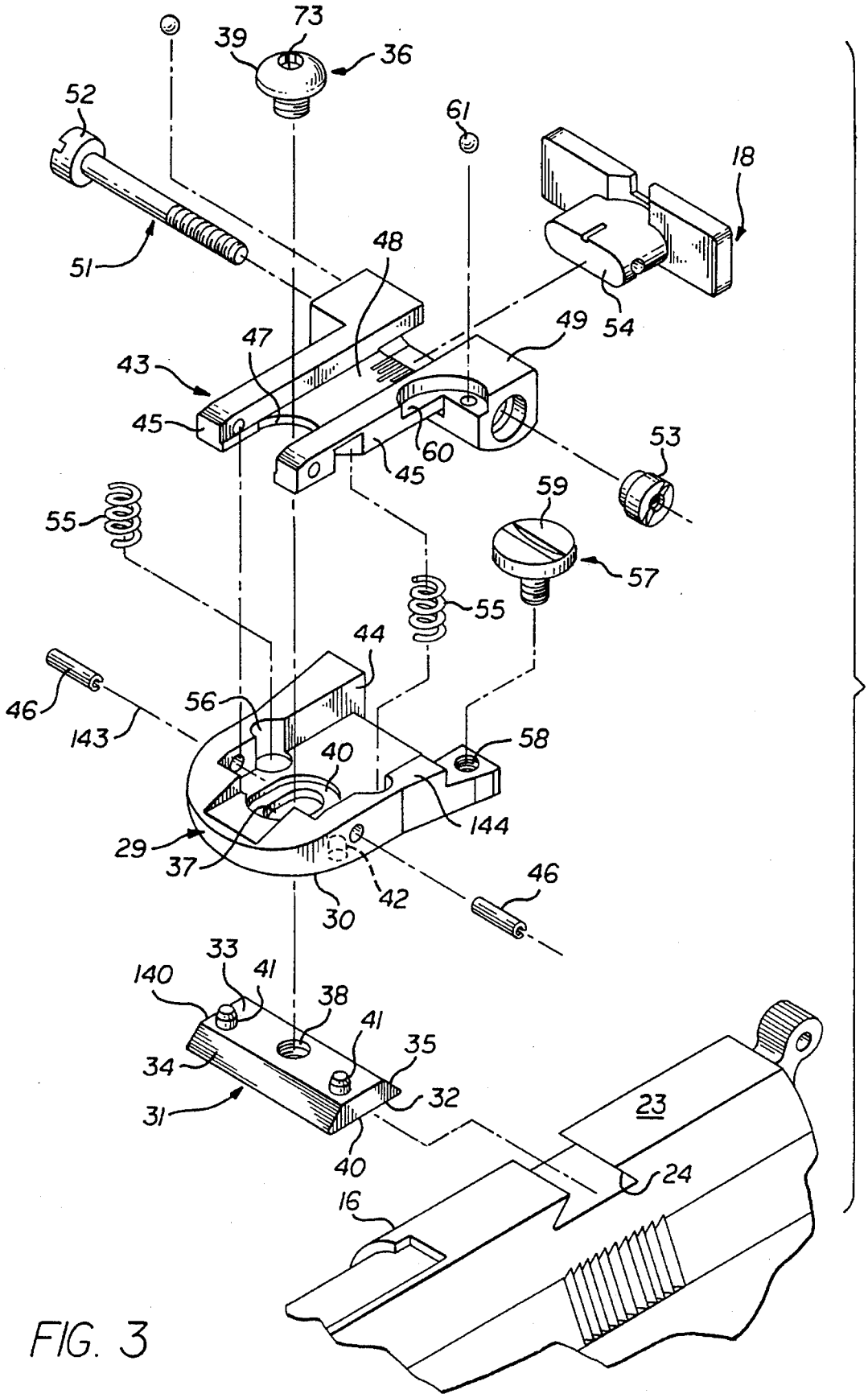
FIG. 3 is an exploded perspective view of the rear sight assembly of FIG. 2.
Figure 7:
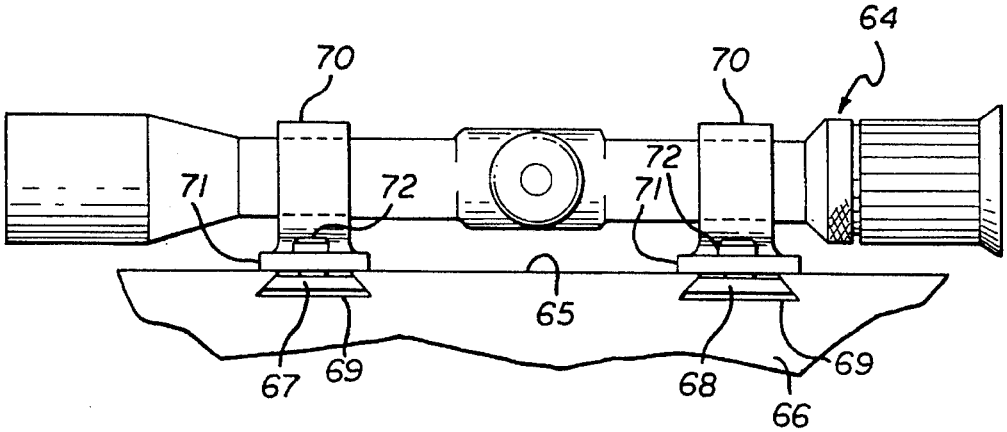
FIG. 7 is a side elevational view of a telescopic sight mounted on a rifle or other gun in accordance with the teachings of the invention.

FIG. 7 shows a typical arrangement for attachment of a telescopic sight 64 to the upper surface 65 of a rifle or other gun 66 by dovetail shaped anchoring parts 67 and 68 shaped in correspondence with the previously described part 31 of FIGS. 2 to 4. Anchoring parts 67 and 68 are received within transverse dovetail grooves 69 formed in the upper portion of the gun. The telescopic sight 64 may be mounted by two rings 70 extending about the sight and having lower portions attached to a pair of horizontal plates 71 engaging the upper surface 65 of the gun. Two screws 72 extend downwardly through openings in plates 71 and are threadedly connected to the anchoring parts 67 and 68, to pull the anchoring parts upwardly relative to the plates upon tightening of the screws and thereby attach the plates 71 rigidly to the upper side of the gun. The connections between rings 70 and plates 71 may be rigid or may be pivotal or otherwise adjustable to enable the sight to be swung into and out of active position relative to the gun, and/or to enable the sight to be adjusted for elevation and-windage. It is also contemplated that in some instances the rings 70 may be omitted, and the telescopic sight may be attached to plates 71 or their equivalent by means other than such rings.

While certain specific embodiments of the present invention have been disclosed as typical, the invention is not limited to these particular forms, but rather is applicable broadly to all such variations as fall within the scope of the appended claims.

I claim:

1. An aiming device for a gun, which gun has a surface containing a dovetail groove with converging side walls, said aiming device comprising:

a rigid body part to be held against said surface of the gun;

a sight carried by said body part to be viewed by a user in aiming the gun;

an anchoring part received within said dovetail groove between said converging side walls thereof, and in engagement with both of said converging side walls;

a threaded fastener extending along an axis through an opening in said body part and threadedly connected to said anchoring part and operable by rotation relative to both of said parts to pull the anchoring part toward the body part in a manner tightening the anchoring part against both of said side walls of the groove and clamping said body part rigidly between said fastener and said surface of the gun to locate the sight relative to the gun; and means on said body part and said anchoring part interfitting in a relation preventing the body part from turning about the axis of said fastener relative to the anchoring part.

2. An aiming device as recited in claim 1, in which said means include a lug projecting from one of said parts and received within a mating recess in the other part.

3. An aiming device as recited in claim 1, in which said sight is a telescopic sight connected to said body part.

4. The combination comprising an aiming device as recited in claim 1, and a gun to which said aiming device is connected and having a surface engaged by said body part and a dovetail groove containing said anchoring part.

5. The combination comprising an aiming device as recited in claim 2, and a gun to which said aiming device is connected and having a surface engaged by said body part and a dovetail groove containing said anchoring part.

6. An aiming device for a gun, which gun has a surface containing a dovetail groove with converging side walls, said aiming device comprising:

a body part to be held against said surface of the gun;

a sight carried by said body part to be viewed by a user in aiming the gun;

an anchoring part received within said dovetail groove between-said converging side walls thereof, and in engagement with both of said converging side walls;

a threaded fastener extending along an axis through an opening in said body part and threadedly connected to said anchoring part and operable by rotation relative to both of said parts to pull the anchoring part toward the body part in a manner tightening the anchoring part against both of said side walls of the groove and tightening said body part against said surface of the gun to locate the sight relative to the gun; and means on said body part and said anchoring part interfitting in a relation preventing the body part from turning about the axis of said fastener relative to the anchoring part;

said means including two lugs projecting from said anchoring part into correspondingly dimensioned recesses in the body part at opposite sides of said fastener.

7. The combination comprising an aiming device as recited in claim 6, and a gun to which said aiming device is connected and having a surface engaged by said body part and a dovetail groove containing said anchoring part.

8. An aiming device for a gun, which gun has a surface containing a dovetail groove with converging side walls, said aiming device comprising:

a body part to be held against said surface of the gun;

a sight carried by said body part to be viewed by a user in aiming the gun;

an anchoring part received within said dovetail groove between said converging side walls thereof, and in engagement with both of said converging side walls;

a threaded fastener extending along an axis through an opening in said body part and threadedly connected to said anchoring part and operable by rotation relative to both of said parts to pull the anchoring part toward the body part in a manner tightening the anchoring part against both of said side walls of the groove and tightening said body part against said surface of the gun to locate the sight relative to the gun;

means on said body part and said anchoring part interfitting in a relation preventing the body part from turning about the axis of said fastener relative to the anchoring part; and an element received above said body part and carrying said sight and which is movable relative to the body part to adjust the sight, said element being shaped to allow access of a tool downwardly to said fastener to tighten it relative to said body part.

9. An aiming device as recited in claim 8, in which said element has two arms connected pivotally to said body part and received at opposite sides of said threaded fastener and shaped to allow access of said tool downwardly to said fastener to tighten it relative to said body part.

10. The combination comprising an aiming device as recited in claim 8, and a gun to which said aiming device is connected and having a surface engaged by said body part and a dovetail groove containing said anchoring part.

11. The combination comprising an aiming device as recited in claim 9, and a gun to which said aiming device is connected and having a surface engaged by said body part and a dovetail groove containing said anchoring part.

12. An aiming device for a gun, which gun has a surface containing a dovetail groove with converging side walls, said aiming device comprising:

a body part to be held against said surface of the gun;

a sight carried by said body part to be viewed by a user in aiming the gun;

an anchoring part received within said dovetail groove between said converging side walls thereof, and in engagement with both of said converging side walls;

a threaded fastener extending along an axis through an opening in said body part and threadedly connected to said anchoring part and operable by rotation relative to both of said parts to pull the anchoring part toward the body part in a manner tightening the anchoring part against both of said side walls of the groove and tightening said body part against said surface of the gun to locate the sight relative to the gun; and means on said body part and said anchoring part interfitting in a relation preventing the body part from turning about the axis of said fastener relative to the anchoring part;

said body part having a downwardly facing undersurface engageable downwardly against said surface of the gun at opposite sides of said anchoring part upon tightening of said threaded fastener;

said undersurface of said body part being essentially planar and being disposed horizontally when in engagement with said surface of the gun.

13. An aiming device for a gun, which gun has a surface containing a dovetail groove with converging side walls, said aiming device comprising:

a body part to be held against said surface of the gun;

a sight carried by said body part to be viewed by a user in aiming the gun;

an anchoring part received within said dovetail groove between said converging side walls thereof, and in engagement with both of said converging side walls;

a threaded fastener extending along an axis through an opening in said body part and threadedly connected to said anchoring part and operable by rotation relative to both of said parts to pull the anchoring part toward the body part in a manner tightening the anchoring part against both of said side walls of the groove and tightening said body part against said surface of the gun to locate the sight relative to the gun;

means on said body part and said anchoring part interfitting in a relation preventing the body part from turning about the axis of said fastener relative to the anchoring part; and means mounting said sight for adjusting movement relative to said body part to introduce a correction into the aiming of the gun.

14. An aiming device for a gun, which gun has a surface containing a dovetail groove with converging side walls, said aiming device comprising:

a body part to be held against said surface of the gun;

a sight carried by said body part to be viewed by a user in aiming the gun;

an anchoring part received within said dovetail groove between said converging side walls thereof, and in engagement with both of said converging side walls;

a threaded fastener extending along an axis through a opening in said body part and threadedly connected to said anchoring part and operable by rotation relative to both of said parts to pull the anchoring part toward the body part in a manner tightening the anchoring part against both of said side walls of the groove and tightening said body part against said surface of the gun to locate the sight relative to the gun;

means on said body part and said anchoring part interfitting in a relation preventing the body part from turning about the axis of said fastener relative to the anchoring part;

said body part having an undersurface engageable downwardly against said surface of the gun at opposite sides of said dovetail groove and which is essentially planar and essentially horizontal when in engagement with said surface of the gun;

said anchoring part having a dovetail cross section corresponding essentially to that of said dovetail groove and having upwardly converging opposite side surfaces engageable with said two converging side walls respectively of the groove;

an element carrying said sight and pivotally connected to said body part for upward and downward swinging movement about a horizontal axis to adjust the sight vertically;

a second threaded fastener threadedly connected to said body part and operable to adjust the sight vertically;

spring means yieldingly urging said element upwardly relative to said body part; and a threaded connection between said sight and said element enabling lateral adjustment of the sight relative to the element.

15. An aiming device as recited in claim 14, in which said element carrying the sight is received within a recess in the upper side of said body part and has two arms at opposite sides of said fastener connected pivotally to said body part to mount the element and sight for said vertical adjustment.

* * * * *